United States Patent [19]

Reynolds

[11] 4,431,182

[45] Feb. 14, 1984

[54] HUMAN FREE-FLIGHT AMUSEMENT DEVICES

[76] Inventor: Francis D. Reynolds, 3060 W. Lake Sammamish Pky. N., Redmond, Wash. 98052

[21] Appl. No.: 374,620

[22] Filed: May 3, 1982

[51] Int. Cl.[3] ..... F31B 7/00; A61G 7/04

[52] U.S. Cl. ..... 272/65; 5/453; 124/26

[58] Field of Search ..... 272/65, 109; 124/16, 124/26; 5/453, 452, 449, 454–458; 128/376

[56] References Cited

U.S. PATENT DOCUMENTS 562,448 6/1896 Zedora ..... 272/65

3,840,922 10/1974 Morrison et al. ..... 5/453

4,279,044 7/1981 Douglas ..... 5/453

*Primary Examiner*—Richard J. Apley

*Assistant Examiner*—Stephen R. Crow

*Attorney, Agent, or Firm*—Robert W. Jenny

[57] ABSTRACT

These amusement devices enable users to experience the sensations of zero gravity or weightlessness in free flight, with the sensations heightened because the users experience gravity forces in excess of one while being accelerated into and retrieved from free flight. The apparatus comprises coordinated, cooperating acceleration and retrieval means. The flight may be essentially vertical or have a parabolic trajectory. Use of the apparatus is not dependent on the physical condition and ability of users.

3 Claims, 14 Drawing Figures

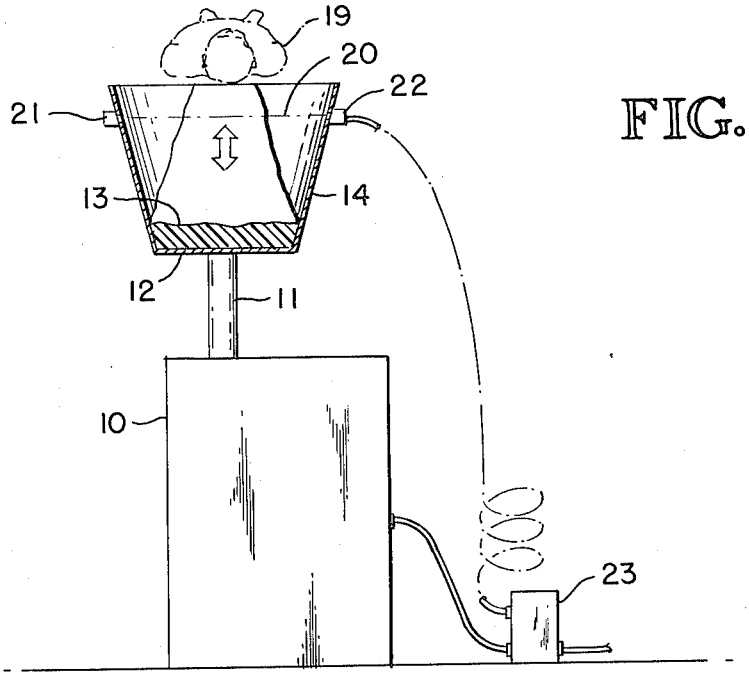
FIG. 1
FIG. 2
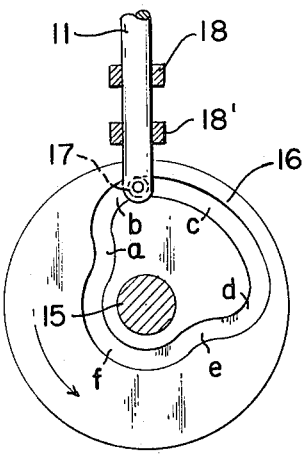
FIG. 3
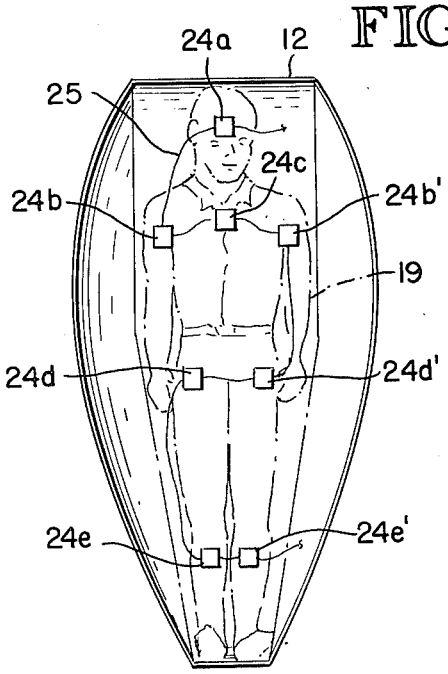

FIG. 7
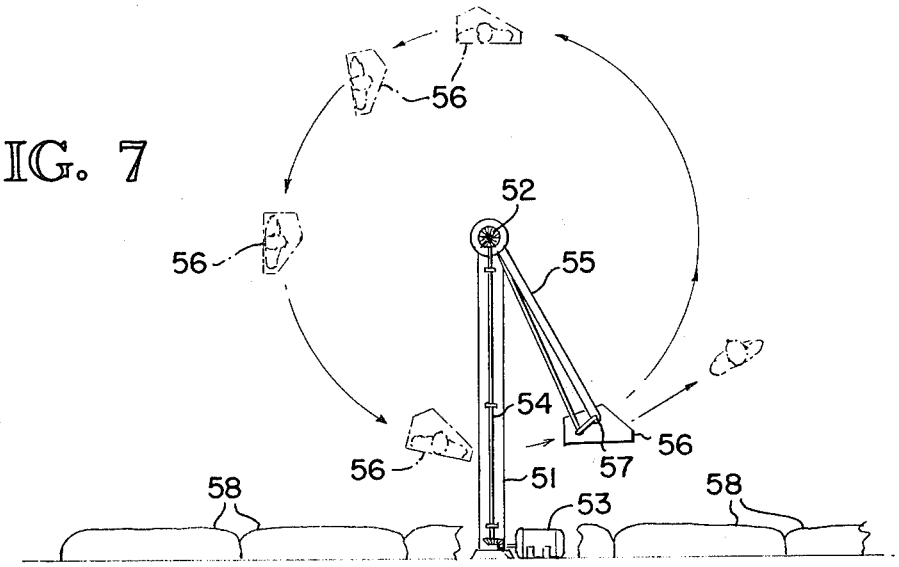
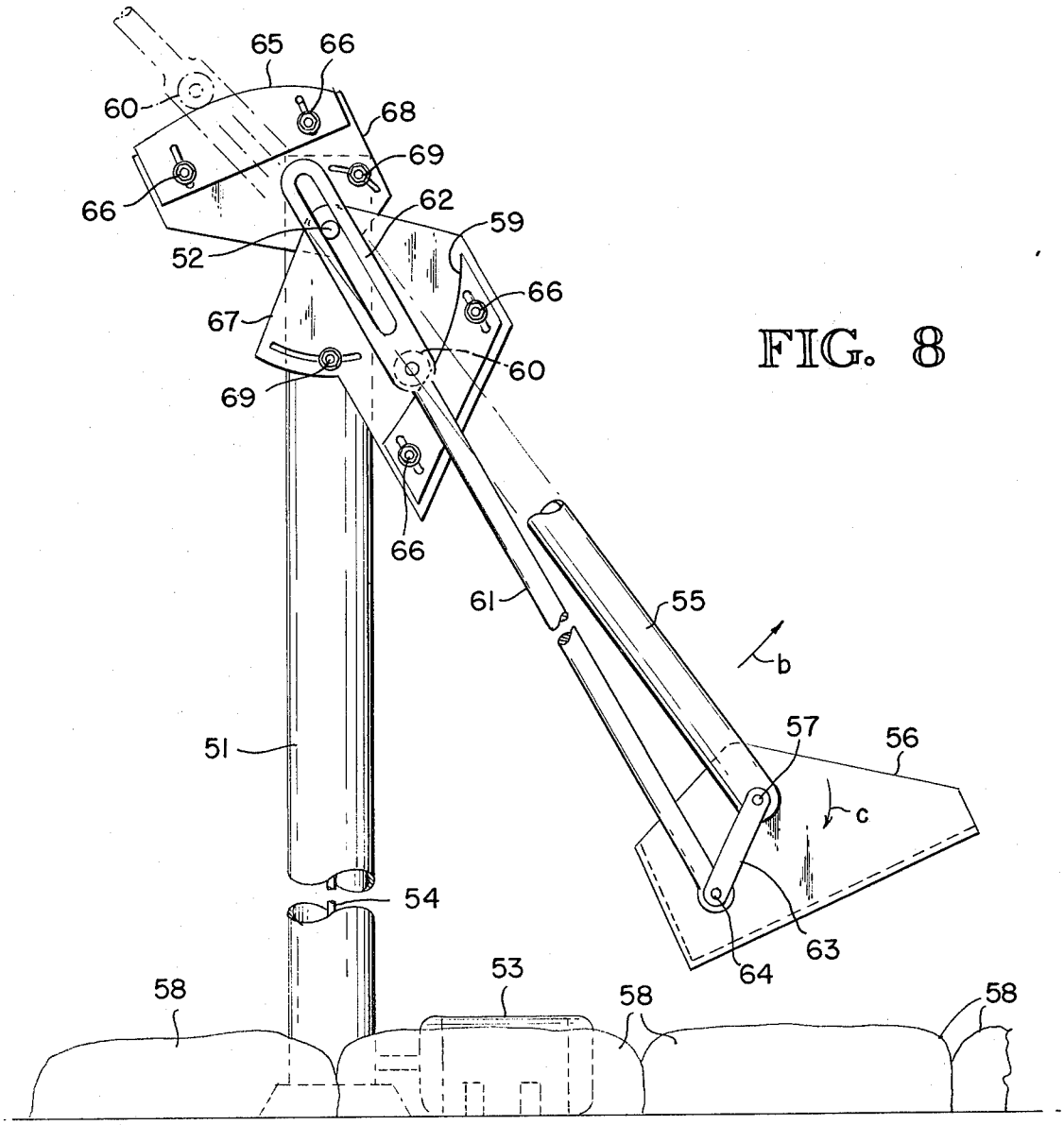
FIG. 8

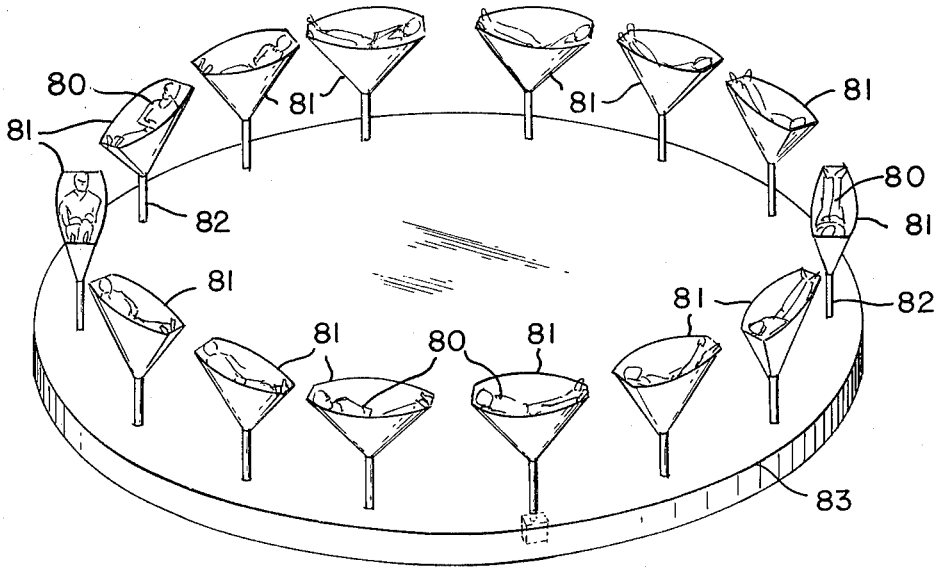
FIG. 9
FIG. 10
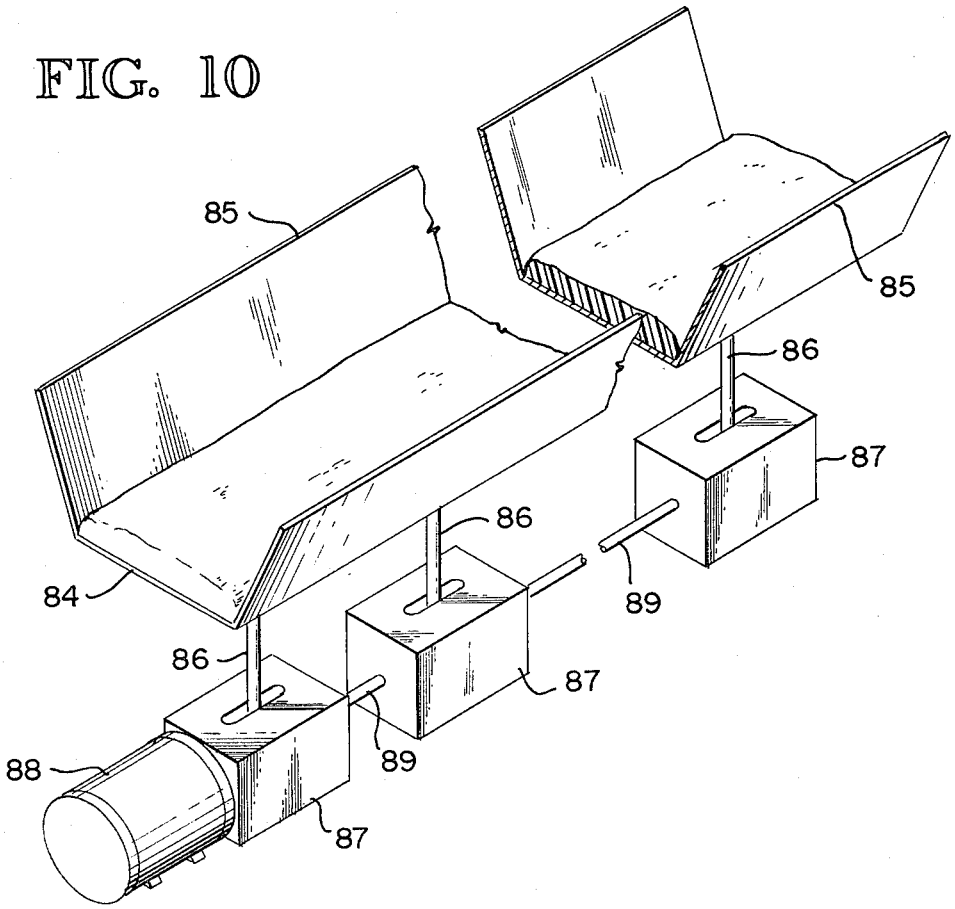

HUMAN FREE-FLIGHT AMUSEMENT DEVICES

BACKGROUND OF THE INVENTION (A) Field of the Invention

The subject invention is in the general field of mechanisms for throwing and catching objects, animals and humans. More specifically the invention is in the field of mechanisms for safely throwing and catching people for their amusement and the thrill experience of acceleration, deceleration, and, in particular, weightlessness. By its nature the invention is in the field of apparatus, machines and devices used in amusement parks and carnivals.

(B) Description of the Prior Art

The earliest known throwing mechanisms are the ancient catapults. These are not known to have been used for catapulting people into free flight for their amusement, nor is it known that they were used in combination with apparatus for catching the catapulted objects. However, U.S. Pat. No. 3,466,053 shows a form of catapult designed to catapult a person and used in combination with a swimming pool as a means for providing a relatively safe landing for the person. Use of this combination of catapult and swimming pool clearly depends on the physical condition and skills of the user. Landing on water can cause excessive stress on the human body and the ability to dive or at least swim would be needed.

U.S. Pat. No. 824,506 shows a relatively more complex and sophisticated apparatus usable for throwing persons. However, no purpose is stated for throwing persons and there is no mention of means for assuring safety of persons thrown. U.S. Pat. No. 826,019 also shows apparatus for throwing (projecting) "projectiles of any kind", including humans and the apparatus is claimed as an amusement device. It is clear, however, that the amusement is for the observers and not the projected person. U.S. Pat. No. 562,448 also shows means for projecting a person, for the amusement of observers, requiring that the thrown person have considerable physical strength and skill.

It is stated that the people thrown by the patented apparatus previously cited may be caught in a net or the like, may catch a trapeze bar, or may be caught by other performers. Safe use of these retrieval methods reqires considerable training and skill.

U.S. Pat. No. 3,948,351 shows a device for catching free falling bodies. The device is basically a trampoline but is spring-tensioned in one direction only (end-to-end). Successful use of this device would require that the user have knowledge of how to land on this type of device, be in strong physical condition and have excellent balance and agility.

U.S. Pat. No. 952,871 shows another trampoline-like machine which is suitable only for use in emergencies in which risk of physical harm to the user is tolerable only because of the user's exposure to greater risks such as fire and smoke in a burning building.

U.S. Pat. No. 1,482,554 shows a tower from which a person may jump or be dropped for amusement purposes. In this invention, the person was to be retrieved from free fall by a cable attached to the person, and means to arrest the travel of the cable. Such apparatus could subject the user to high, uncomfortable and dangerous stresses during retrieval and would partially defeat the desired sensation of free flight by the presence of the attached cable.

U.S. Pat. No. 2,068,386 shows a combination of a spring-supported jumping height and distance amplifier and several resilient landing areas. The invention, intended for amusement, would require strength and skill of the user, and would be dangerous to users not employing adequate caution. The inflated jumping beds currently used in amusement parks are similar in nature and safer than the cited invention, but still depend solely on user strength and coordination.

U.S. Pat. No. 3,310,305 shows a diving platform in conjunction with a trampoline located at the edge of a swimming pool. Like the apparatus just cited, use of this invention depends solely on the skills of the user. It would be dangerous to a non-skilled user since an inexact jump would result in missing or improper contact with the trampoline. This apparatus is therefore suitable for use by athletes and performers, but not only by untrained persons.

Another related prior art apparatus is the "mechanical bull", designed to test the strength and ability of riders and to throw them off if they are unable to hang on. Therefore, these mechanisms are different from the subject invention in both purpose and implementation. Free flight, if any, is unplanned and uncoordinated, and the landing may be in any orientation and may be dangerous to the person thrown.

Ski-jumps can be considered apparatus for launching humans into free flight and the sloping of the landing sites for the jumpers is a good technique for minimizing of the landing impact at the end of the flight. However, it is well known that very few people can experience the sensations of free flight and zero gravity by ski-jumping because of the skill and physical capability required.

Various amusement devices provide some of the sensations of weightlessness, these devices including roller coasters and loop-the-loops. However, in such devices the persons are restrained in, and/or encumbered by seats. They usually also grasp structure, handles and the like, thus detracting from the sensation of free flight.

The desire for and thrill of experiencing free flight is strong and is manifested by many well known activities. These include children being tossed up and caught by adults, blanket tossing as practiced in particular by Eskimos, trampoline activity, snow and water ski-jumping and simple jumping from safe heights into hay or snow. The free fall part of sky diving is a satisfying way to experience weightlessness for an extended period; however, this activity again is limited to the few with the time, money, physical and psychological attributes needed for it.

The desire of people for the thrill of free flight is also manifested by the popularity of vicariously experiencing it in watching cliff divers, trapeze performers and so-called human cannon balls.

It is clear, in view of the above stated facts and cited prior art, that large numbers of people have a strong desire to experience the sensations of free flight without encumbrances of any sort and with a high degree of safety. It is also clear that the desire has not been satisfied because prior art means for providing such satisfaction have been useful only to relatively few people because of various factors and combinations of factors, such as need for particular physical capabilities, unacceptable hazards and/or amounts of time, money, training or skill required.

It is absolutely essential to the utility of the subject invention that the persons launched into free flight be able to land safely regardless of their physical conditions and capabilities. For short duration flights current and prior art apparatus will be adequate, apparatus such as safety nets, inflated pads, foam pads, inflated and vented pads and the like. However, landing after longer flights presents requirements not met by the current and prior art apparatus. To provide the necessary soft landing from a long flight with a reasonable depth pad or mattress it is necessary that the deceleration force be very nearly constant throughout the deceleration. It is also necessary that material mass suddenly accelerated by the landing person be minimal so that the force required to accelerate the mass is also minimal and, preferably, negligible. Also, it is most important that there be minimal concentrated forces generated when and if the first contact of a landing person with the bed is with an extended appendage such as an arm, a leg or the neck and head. It is essential that no major deceleration of any part of the person begin until the primary mass of the body is in contact with the bed. The most sophisticated known prior art, comprising an inflated mattress made of thin, flexible material with inflation pressure maintained nearly constant in spite of changes in the volume, meets all the described requirements except the elimination of concentrated loads on extended appendages. Meeting this requirement was a significant part of the problem solved by the subject invention.

SUMMARY OF THE INVENTION

The primary objective of the subject invention is to make it possible for the general populace to experience the sensations and thrills of free flight and weightlessness at reasonable cost and with very minimal risk. The desire for such experience has been long-standing, generally unmet and whetted in recent years by accounts of experiences in space. It is a further objective that the apparatus which makes it possible for the general populace to have this experience to be rugged, simple, dependable, easy to safely operate, and economical to construct and use. Another objective is that use will require attachment of apparatus to the user and will not require any special apparel or procedure to protect or adapt the user for the use.

It can be seen from study of the prior art and from general awareness of the kinds of amusement apparatus commercially available that the above identified objectives are not presently met, for various reasons and combinations of reasons. Most people do not have the physical capabilities and skill needed for use of the known kinds of apparatus and techniques by which free flight can be achieved. Primarily the need has remained unmet because there has been no equipment comprising free flight accelerating and retrieving means specifically coordinated in terms of design and function to meet the need. Further there has been no retrieving means which takes into account the fact that the initial contact between the person and the retrieval apparatus is quite likely to involve an arm, a leg, or the head and neck. For the general populace, these appendages can not in all cases withstand the forces involved. This situation makes it necessary that the retrieval apparatus provide little resistance to the further travel of the person's primary mass, the body. Provision of shock absorbing retrieval apparatus having the described characteristics is a further objective of the subject invention.

The subject invention can be implemented in many ways, each of which will meet the stated objectives by the incorporation of specific basic features. The users are supported and accelerated into free flight by means not requiring any attachment to the users, not requiring the user to maintain balance and not requiring prevention of voluntary physical action on the part of the user. The trajectory of the free flight is consistently within a limited envelope. The nature and positioning of the retriever are coordinated with this envelope of trajectories and are such that the free flight of human beings can be safely intercepted and decelerated to zero velocity with optimum safety.

An example implementation is briefly described as follows: A person is launched into a parabolic free flight trajectory by a pneumatic-powered accelerating device. The person is then caught and safely decelerated by a retriever.

The beginning point of the trajectory is at the accelerating device; the trajectory will have an apex, and an ending point at the retriever.

The retriever is located at an appropriate point along the trajectory and its working surface is oriented essentially at right angles to the trajectory at the point the trajectory intersects the working surface of the retriever. The retriever comprises a framework filled with elongated inflated members made from smooth flexible material. The members are arranged side-by-side with their long axes perpendicular to the working surface. The working surface consists of the closed ends of the members. In operation, an arm or a leg, for example, contacting the working surface essentially end-on will penetrate with minimal resistance and stress into one or several members, turning the members partially inside out, or into the interstices between members. When the greater mass and larger size of the body contacts the working surface, the contacted members compress in unison to absorb the kinetic energy of the person. The person then essentially "floats" on the working surface and, because of its sloped orientation, slides gently off the surface and onto a horizontal surface which is resilient enough to enable the person to easily stand and walk off. There are appropriate arrangements provided to prevent acceleration of passengers into free flight until and unless the retrieval area is clear of previously accelerated people.

In modification of the example implementation the retriever is a slide having a slippery, padded surface aligned essentially parallel to and close to the trajectory so that the motion of the person being retrieved is essentially parallel to the surface of the slide as contact is made between the person and surface. The person then is decelerated by the friction of sliding along the surface and by appropriate change in the slope of the slide from downward to level or slightly upward. The person stands up and walks away when sliding has stopped.

Consideration of these example implementations will show that the desire for experiencing free flight and the associated feelings of weightlessness can be met economically and safely by people without special physical attributes, skills or abilities and without the inconvenience associated with changing to and from special apparel, becoming wet, or being fitted with or constrained in any kind of apparatus.

The invention is more completely described and further features and advantages brought out in the following part of the specification and in the drawings in which details are described in the interest of providing an adequate disclosure but with no intent to limit the scope of the invention as delineated in the appended claim.

BRIEF DESCRIPTION OF THE DRAWINGS

FIG. 1 is a schematic view of vertical-flight apparatus which serves as both the accelerator and retriever for one or more people.

FIG. 2 is a preferred mechanism for producing the accelerations and decelerations required for the implementation of the FIG. 1 apparatus.

FIG. 3 is a schematic illustrating the use of sensors in the cradle of the apparatus of FIG. 1, to assure proper orientation of a person prior to acceleration into flight.

FIG. 7 is a schematic of another preferred parabolic trajectory accelerator.

FIG. 8 is a detail of a mechanism for meeting the requirements of the implementation of FIG. 7.

FIG. 9 is a schematic representation of a number of accelerating/retrieving apparatuses arranged in a circle for accelerating and retrieving a number of people into and from vertical flight.

FIG. 10 shows a rectilinear configuration for accelerating and retrieving a number of persons into and from vertical flight.

DESCRIPTION OF PREFERRED EMBODIMENTS

Figure 4:
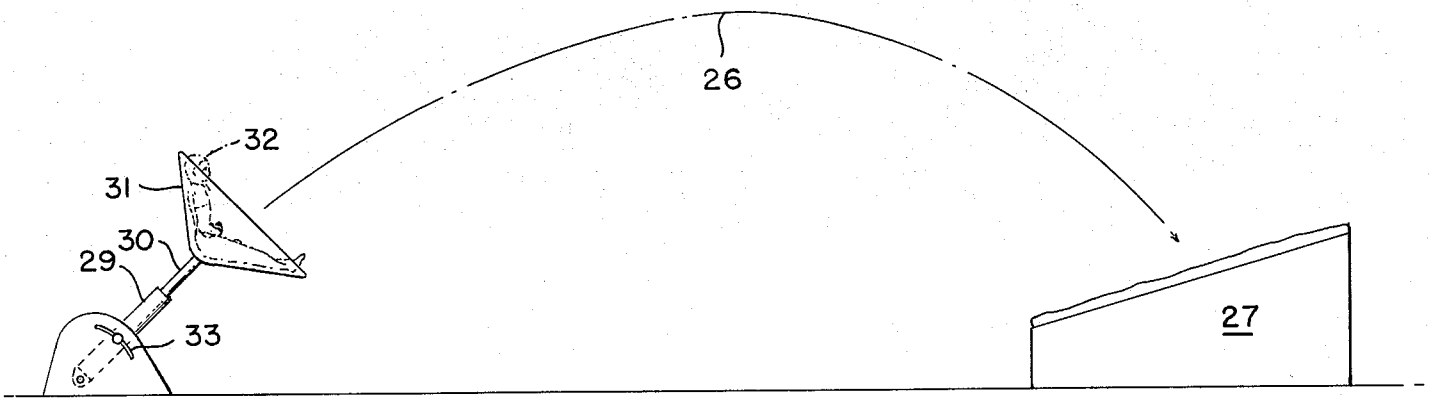
FIG. 4 is a schematic illustrating coordinated means for accelerating one or more persons into a parabolic trajectory and retrieving them.

It is obvious that accelerating people into the air by machine in an inadequately controlled manner could be highly dangerous. Therefore, a brief discussion of the theoretical and practical requirements for safety is in order, since these requirements have dictated the details of the several implementations of the subject invention.

The object of safety is met in the invention by the practical application of the basic laws of mechanics in limiting to safe levels the accelerations and decelerations to which people using the invention are subjected.

There is no theoretical limit to the height and distance to and over which an amusement device could safely throw and safely catch a person, provided the accelerations and decelerations are within safe limits. The practical limits are economic rather than technical. A trampoline, fireman's net, hay mow, or a parent's arms are adequate deceleration means for human falls of a few feet. A pole-vaulter's landing pad can safely decelerate an athletic person falling from 40 to 50 feet, provided the person is properly oriented. Large, specially-built air bags have safely caught stunt men after falls of up to 200 feet.

Acceleration and deceleration (or positive and negative acceleration) are theoretically identical, being represented by the same formulas. Each is rate of change of velocity per unit time, either increasing velocity (acceleration) or decreasing velocity (deceleration). Both may start from any initial velocity. Therefore, the human limits to acceleration and deceleration are the same, and the acceleration and deceleration aspects of the subject invention are treated identically.

The acceleration and deceleration levels that human beings can safely withstand depend on the duration of the acceleration and upon the orientation of the subject with respect to the direction of the acceleration. The supine orientation (seated or lying on one's back), with the acceleration force holding the subject to the back of the chair or onto the bed, was found in space engineering tests to permit the highest safe acceleration. In the supine position, humans can safely withstand plus or minus 10 gs for several minutes, g being the symbol for the acceleration of gravity which is approximately 32.2 feet per second per second. For shorter periods the permissable g level increases. One hundred gs may be safely tolerated by healthy humans for one hundredth of a second.

The flight heights and distances anticipated for the various implementations of the subject invention range from a fraction of a foot to 30 feet. The accelerations and decelerations will be in the range of two to ten g, with acceleration and deceleration durations in the range of less than a tenth of a second to several tenth of a second. It will be noted that these acceleration levels and durations are but a small fraction of the values demonstrated to be tolerable by humans. The various implementations of the invention generally use the optimum supine orientation of the person during both acceleration and retrieval for maximum safety and comfort.

In the further interest of safety all apparatus used in this invention is to be carefully designed and built and to be tested with instrumented dummies weighing the same as humans. Further it is understood that all such apparatus would be inspected and maintained frequently and thoroughly to assure that the safety level designed and built into the apparatus is in no way compromised.

The scope of the invention covers all of the ways that nonspecialized people can be launched into the air and caught safely by amusement devices and equipment. This disclosure details a number of preferred embodiments and variations of the invention, but it will be obvious that many other implementations of the invention not specifically described are possible.

Three basically different concepts may be used to decelerate people safely at the termination of their flights through the air in the several implementations. The first of these is a resilient of soft landing bed relatable in concept to a safety net. The second concept is that of matching a slope or slide to the final portion of the flight trajectory of the persons, with the slide curving upward to decelerate the persons. This concept is like the technique of landing after snow ski jumps.

The third concept is that of decelerating persons safely at the termination of their flights by machine. The braking of an automobile is an example of the deceleration of persons safely from high velocity by machine. In that case the passengers and driver, like the people in conventional amusement rides, are always at the same velocity as the seat, since the people never leave their seats. In one type of implementation of the subject invention the seats are decelerated and the people are not, so that the people fly from their seats. Then, when a person is to be retrieved (reseated), it is necessary that the seat velocity, direction and position be made to match those of the person at the time of reseating. After reseating, the person and seat are decelerated together. In some variations on this implementation of the invention, the people are caught in the same seats or cradles they flew from. In more sophisticated variations they land in different seats, cradles or beds than they flew from. Obviously, the approximate matching of the velocity of the machine-driven cradle, seat or bed to the velocity of the landing persons, and approximate matching of the time, place, and direction of this substantial conincidence of velocities is essential to safe deceleration of the persons. Due to the predictability of flight trajectories and velocities after a machine launch and the predictability of the operation of machine decelerators, adequate matching is readily achievable. In practice, some deviations from exact coincidence and matching of landing velocity, direction, time and position are safely permissable because of the resilience and adaptability of the human subjects and of the resilience of padding incorporated in the catching apparatus. Also, generously-proportioned sides and backs are provided to guide the persons safely into catching apparatus that may be slightly misaligned at the time of catching.

A number of power sources are suitable for accelerating people into safe, controlled free flight. These include but are not limited to gravity, springs, pneumatics, hydraulics, internal combustion, and the inertia of rotating mechanisms. Implementations of some of these are disclosed in detail.

A gravity method of accelerating people into free-fall parabolic flight is to provide a sloping slide down which persons slide. The slide is reflexed upward in its lower portion such that the velocity vector of the sliding person is redirected to some angle above horizontal so the person leaves the end of the slide rising and flies through the air to a deceleration device, such as another slide or an energy absorbing bed.

All of the implementations of the subject invention may be constructed from common materials by known processes, with a choice of materials and processes being available in most cases. There are no critical requirements which demand high technology processes or advanced materials. In particular, the materials, processes and design practices currently used by the amusement rides and amusement devices industry are well suited for the design and construction of the subject invention.

In more detail, welded tubular steel construction is recommended for most of the structural portions. Riveted or welded aluminum structures or laminated fiberglass structures are desirable alternates where lighter weight is important.

The cradles and seats can be manufactured from polyester resin/fiberglass fabric layup or polyester resin and chopped and sprayed glass fibers over molds. Reaction injection molding would also be well suited.

The structures of the various implementations are designed to be dismantleable or hinged so that they can be folded for transport in a manner similar to existing amusement ride equipment. The transmission and mechanism components of the invention such as gears, cams, shafts, links, and levers, will usually be made of steel, but in some cases aluminum, brass, plastic, or sintered powder-metallurgy parts may prove to have performance or cost advantages.

In portions of the apparatus where friction is of obvious concern, ball or roller bearings are recommended. In some applications plain bearings are suitable.

In the electrical portions of implementations where electronic control is selected, the elctronics can be integrated-circuitry, designed and constructed to state-of-the-art standards. The switches, indicators, light sources and other electrical components are all standard commercial parts available from a number of vendors. Selection of suitable items can readily be made by an electrician, electronic technician or an electrical engineer.

If the design employs hydraulic control or power transmission, the required components again can be readily selected from catalogs of manufacturers of hydraulic equipment. The mechanical power transmission requirements can also be met by commercially available shaft, gearing, belt, or chain drives.

Although other prime mover power is practical for use in powered implementations of the invention, electric motors or internal combustion engines are preferred. These may be sized and selected from commercial catalogs by an engineer or other qualified designer. In some implementations the variable speed and control features of direct-current motors may be useful, but in the vertical flight implementations the relatively constant speed of a.c. motors provides a convenient and adequately-accurate flight timing standard.

The embodiment shown in FIG. 1 is a basic form of the invention. In this form actuator mechanism 10 is an apparatus, described in more detail below, which causes column 11, to which cradle 12 is attached, to move up and down in specially controlled motion. First the cradle and occupant(s) together are accelerated upward. Then the cradle is rapidly decelerated while the occupant(s) continue in upward motion (free flight). The occupant(s) upward motion slows to zero and becomes downward under the effect of gravity. As the falling occupant(s) approach the cradle the actuator mechanism 10 accelerates the cradle downward with timing and velocity such that when the occupant(s) contact(s) the cradle the velocities of person and cradle are substantially equal. The mechanism then decelerates the cradle and occupant(s) together to zero velocity.

The cradle 12 is lined with padding 13 to further protect sensitive body parts such as elbows and the head from injury. Sidewalls 14 of the cradle are sloped as shown to assure that occupants are properly positioned in the cradle upon recontacting it in the event that wind or occupant actions cause unexpected misalignment of the occupant(s) and cradle.

If persons are given repetitive acceleration, flight, catching and deceleration on a randomly timed basis by this apparatus, a desirable factor of suspense is introduced.

Actuator mechanism 10 can be implemented in a variety of ways. A preferred mechanical method is shown in FIG. 2. A power source, not shown, drives the shaft 15, which rotates double-acting radial cam 16, causing cam follower 17 to drive cradle column 11 vertically up and down within fixed slide bearings 18. Cam 16 can be designed to toss the occupant(s) to any particular desired height. In order for the height to be the same for occupants of all weights, the rotational speed of the cam is set at a design value and held constant with close limits during operation.

The vertical velocity required at launch to produce a specific flight height is determined by the formula $V=\sqrt{2gh}$ where V=velocity, g=the acceleration of gravity, and h=the height of the flight. For example, if it is desired to boost the cradle occupants three feet into the air, the required vertical velocity at launch is $\sqrt{(2)(32.2)(3)}=13.9$ feet per second. The total flight time is the rise time plus an equal fall time and is represented by the formula $T=2\ V/g$. For the example of 3-foot height, $T=[(2)(13.9)]/32.2=0.86$ second.

Referring still to FIG. 2, segment a of the cam produces constantly upward motion of column 11; segment b decelerates the upward-moving cradle. Segment c is a dwell, keeping column 11 at a fixed height while the occupant is in flight; segment d accelerates column 11 downward so that its velocity matches that of the occupant at the time the occupant again contacts the cradle. Segment e decelerates the column and occupant to zero velocity. Segment f is a dwell between cycles, during which the apparatus can be stopped to allow occupant(s) to leave and be replaced.

The size of the cam and the slope of cam segment a in conjunction with the cam angular velocity, will determine vertical acceleration, vertical velocity at launch, and therefore flight height. The dwell time of segment c plus the downward acceleration time of segment d must be equal to the flight time of the persons. Those skilled in cam design will have little difficulty in designing cams to meet these requirements.

The mechanism of FIG. 2 is rotary-to-linear. Strictly rectilinear devices such as pneumatic or hydraulic actuators can also be used. In these cases, however, the timing of the mechanism to allow for flight between launch time and landing time must be provided in a differentf manner, since the inherent timing of a constant-speed rotating mechanism is not available. FIG. 1 illustates one non-rotary method of timing the flight, using radiant energy. The falling occupant 19 interrupts a light beam 20 between light source 21 and photo cell 22 which actuates controller 23 causing pneumatic, hydraulic or other recti-linear actuator 10 to accelerate cradle 12 downward until its velocity matches that of the falling person 19 at the instant of landing. Then the actuator smoothly decelerates the cradle and occupant to a stop.

Instead of sensing the falling person, an independent timer can be used in conjunction with recti-linear actuators. The timer is adjusted to the same time interval as that of the flight the actuator imparts to the occupant. The timer will initiate downward acceleration of the cradle by the actuator at a selected time after launch such that the cradle and the occupant have the same downward velocity at the instant of contact. When a hydraulic or pneumatic actuator is used, the fluid pressure may be controlled to launch people of different weights to the same height, or to lauch people to different heights according to their wishes.

FIG. 3 is a detail top plan view of a single-occupant launching and landing cradle 12 showing diagrammatically the addition of pressure or weight sensors 24. The purpose of these sensors is to monitor the position or orientation of the occupant in the cradle to assure that the occupant is in a safe orientation for acceleration before the acceleration occurs. While most occupants would be expected to lie fully in the cradle as intended prior to acceleration, some adventurous persons might attempt to assume other positions which could introduce personal risks.

The sensors 24 are simple pressure or weight-actuated switches, Hall-effect devices or other appropriate sensors. They are connected in series by wire 25 as indicated, such that a launch signal is obtainable only when all of the sensors are actuated simultaneously. With the number and placements of sensors shown, for example, the occupant's head would have to be in contact with the cradle so as to actuate sensor **24*a*, his upper arms must actuate the 24*b* sensors, his back 24*c*, his buttocks 24*d*, and his calves would have to actuate 24*e***, all simultaneously, indicating that the occupant is lying against the cradle correctly. The output signal from the cradle sensors could actuate a visible or audible signal, not shown, as an indication to the operator of the apparatus, or it could be used to control the mechanism such that launch could not be initiated until the occupant is properly oriented in the cradle.

In the described variations of this implementation of the invention occupants are launched vertically and land in the same cradle from which they were launched. An alternate implementation employs a launcher which accelerates occupant(s) into a parabolic flight trajectory and catches them in a retriever separate from the launcher and located along the flight trajectory. FIG. 4 shows this implementation in basic concept, with an actuator accelerating a column, cradle, and thereby occupant(s) into flight in a parabolic trajectory 26 for a landing in retriever 27.

In the simplest form of this implementation, the retriever 27 would be an energy-absorbing pad, air bag or safety net, but alternatively the timed mechanical deceleration concepts disclosed in previous paragraphs and shown in FIGS. 1 through 3 may be used.

Figure 5:
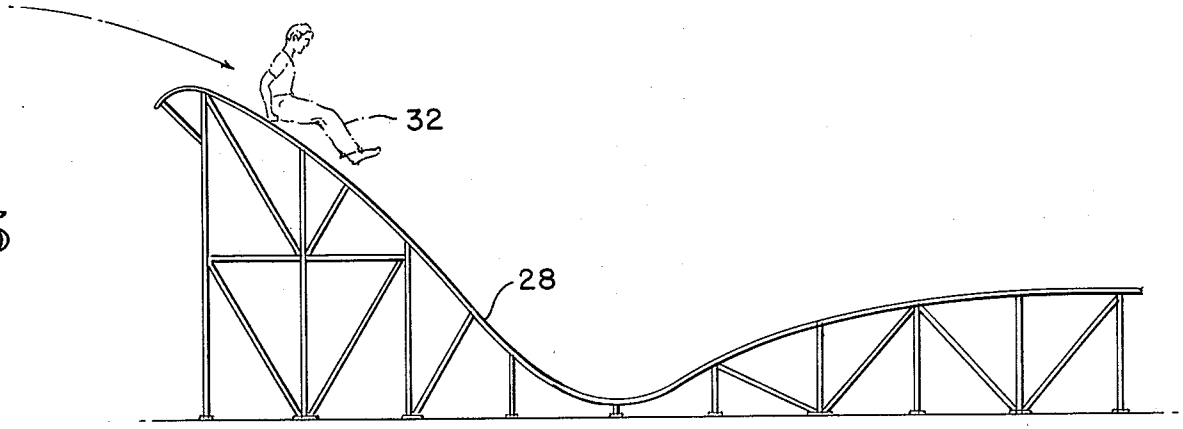
FIG. 5 illustrates an alternate retrieval means which constitutes a slide coordinated with the trajectory in location, orientation and shape.

FIG. 5 illustrates another variation of the separate launch and landing implementation, wherein the retriever is a reflexed slide 28, the upper portion of which is adjusted to, below and essentially parallel to the flight trajectory of the person. The person lands on a steep upper slope like a landing ski jumper and slides along a gradually-reflexing curve, smoothly decelerating to a stop. Alternatively the slide could be essentially flat and horizontal and start near the apex of the trajectory, so the landing person would slide horizontally and the horizontal velocity would be dissipated by slide friction.

A slide decelerator may also be used in a different implementation of the invention (not illustrated), where the person is allowed to jump or drop into free fall vertically downward from a tower or platform. Then, after a fall of some feet, the person engages a slide which is substantially vertical at the point of contact but which curves gradually to horizontal or above horizontal to decelerate the person safely.

A preferred simple accelerator for the implementation of FIG. 4 uses a linear pneumatic actuator 29 which accelerates piston rod 30, cradle 31 and person 32 at launch. The pneumatic actuator 29 is provided with compressed air through a control valve not shown, from an air storage tank and an air compressor not shown. The actuator is pivoted in slotted base 33 premitting adjustment of the launch angle.

The pneumatic accelerator concept permits launching people of different weights within a limited trajectory envelope by adjusting the air pressure or the effective stroke. Heavier persons would receive greater launch pressure or a longer launch stroke to assure substantially the same trajectory given to lighter persons. Likewise, if a long retriever is provided, safely permitting a wide envelope of trajectories, the apparatus could be adjusted for short, medium or long flights according to the wishes of the persons to be launched.

Figure 6:
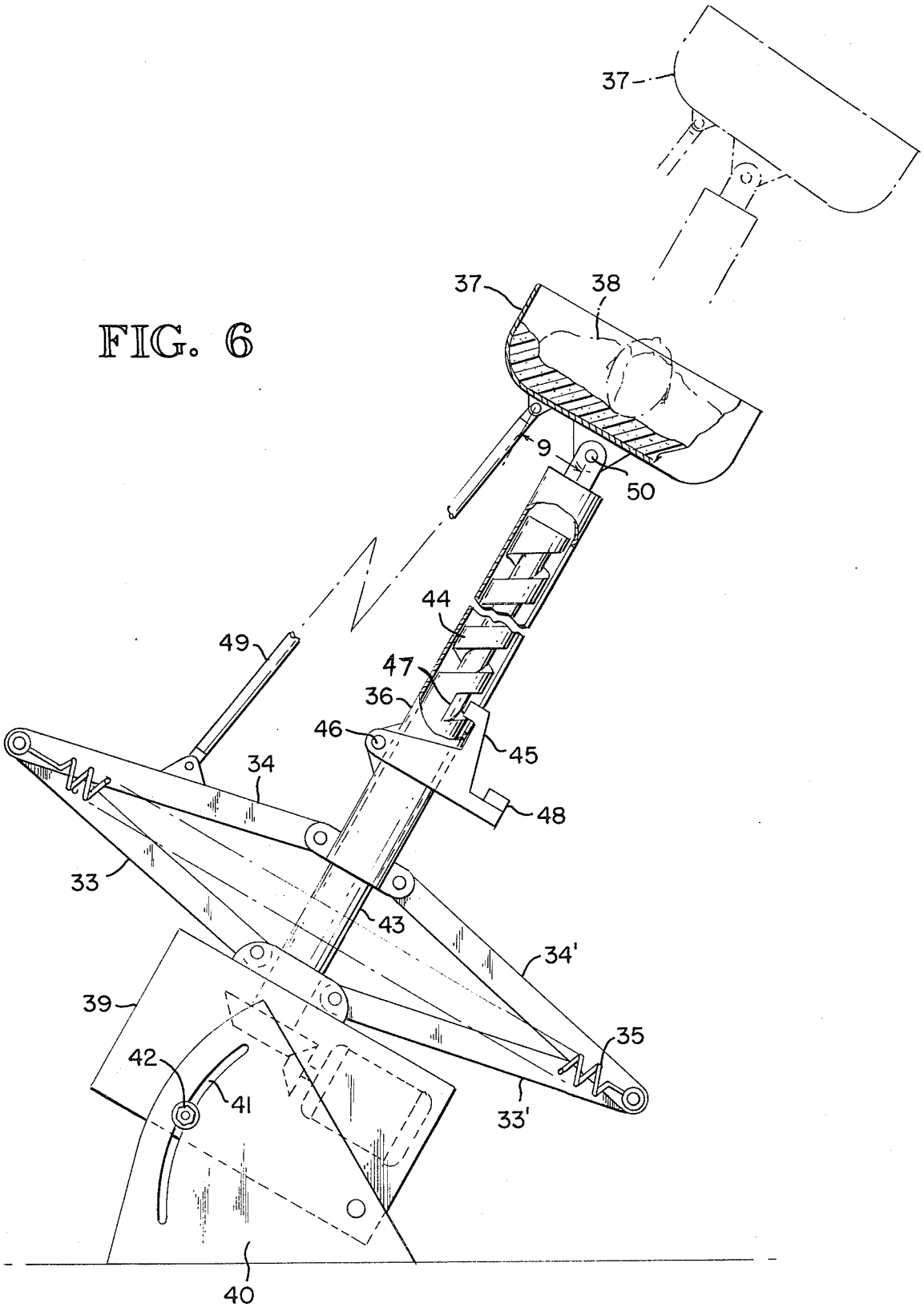
FIG. 6 shows one preferred accelerator mechanism for launching people into parabolic trajectories.

Alternatively, in a parabolic trajectory launcher, one or more deflected springs may be used in conjunction with a non-linear linkage as illustrated by FIG. 6. Links 33 and 34 are operated during launch by tension spring 35 which thereby accelerates cradle guide tube 36 and cradle 37. The occupant(s) 38 are launched into flight when the cradle decelerates as spring 35 reaches its unstressed length. For symmetry and balance two parallel springs 35 and 35' (not shown) may be used, one on each side of the central shaft.

It may be observed that the thrust on the cradle in the beginning of the launch stroke as shown in FIG. 6 will be low due to the acute angle between the links 33 and 34, even though the spring force is maximum in the beginning. In mid stroke, however, with about a 90° angle between the links, the spring force is more effectively transmitted to the cradle and the cradle thrust is greater, even though the spring force per se is now less due to partial relaxation of the spring. As the cradle continues to rise the angle between links becomes obtuse and the further declining spring force is multiplied by the increasing mechanical advantage of the linkage to maintain a moderate level of cradle thrust. This non-linear linkage provides a smoother and more comfortable launch than would be obtained by eliminating the linkage and using a power spring parallel with the cradle travel axis. The latter configuration would produce maximum thrust at the initiation of launch, and therefore a high and potentially dangerous launch shock.

Still referring to FIG. 6, power unit 39 is hinged to base 40, and the launch angle may be adjusted by means of slot 41 and clamp 42. Power unit 39 serves to recock the launcher after a launch by rotating shaft 43 which is integral with lead screw 44. Latch 45, which is pivoted to cradle guide tube 36 at pin 46, serves as a partial nut, engaging lead screw 44, pulling tube 36, cradle 37 and occupant 38 down when the power unit rotates the shaft, actuating linkage 33–34 and stretching tension power spring 35.

When the cradle assembly is cocked at the bottom of its stroke, the run-out 47 at the end of the lead screw 44 causes latch 45 to unlatch from the lead screw automatically as the latch runs off the end of the threads, thus initiating launch by the energy stored in spring 35. During the launch rise of the moving assembly the inertia of the counterweight 48 attached to latch 45 keeps the latch from re-engaging the lead screw. After launch the latch can be re-engaged manually, or automatically by means not shown, to permit powered recocking of the launcher.

It may be desirable to slightly rotate the occupant being launched, imparting rotary as well as linear acceleration. This rotation can cause the person to roll about a head-to-toe axis or, if the cradle is so oriented, to pitch slightly or, if desired, somersault completely heels over head in either direction. In each case, the rotation is tailored to land the flier in a supine position in the retriever. In this implementation the desired roll or pitch angular velocity is imparted to the occupant during launch by means of a linkage as follows. The angle of link 34 changes during launch, forcing the cradle 37 via link 49 to pivot (counterclockwise in this view) about pivot 50. The amount of angular velocity imparted to the cradle and occupant is controlled by varying the length of moment arm 9 between link 49 and pivot 50.

To induce cradle angular velocity in the opposite direction during launch, link 49 would be placed on the other side of tube 36, connecting it to link 34' and to the right side of the cradle.

Another preferred accelerator for parabolic flight implementations of the invention is illustrated in FIG. 7. In addition to flight thrills this accelerator provides a high order of near weightless and centrifugal force thrills to the occupant(s) prior to launch. As shown, one or more towers 51 support central drive shaft 52 powered by a power unit 53 and transmission shaft 54.

Arm 55 is driven by shaft 52 through a clutch mechanism not shown and cradle 56 is pivoted to the arm 55 at shaft 57. The rotation of the cradle with respect to the arm is controlled by means described below.

With this implementation the operation and launching of the occupant(s) is accomplished basically by clutching the arm to rotating shaft 52 after the cradle is occupied by one or more persons when at its lowest point. The cradle is raised along with the occupants to the top of the arc described by the end of the arm and in the direction shown by arrows. The raising of the mass of the cradle, occupants and arm stores potential energy. Just past top dead center the arm is declutched from the shaft and the cradle, occupants and arm are accelerated in a downward arc by gravity, converting the potential energy to kinetic energy. The swing continues downward to bottom dead center and then on upward to a specified point (such as that shown) at which one of several actions, described below, causes the occupant(s) to leave the cradle in the tangential direction while the cradle continues to move in the arc. The occupant(s) then enter free flight in a parabolic trajectory to a retriever, not shown here. Maximum flight range, for a given tangential velocity, is achieved when launch occurs at an arm angle of 45° above the bottom position during the upward swing of the arm.

After launch of the occupant(s) the arm is decelerated by gravity and then swings downward to the bottom dead center position where its motion is arrested by any of the means well known to people of ordinary skill in the art.

The aforementioned actions which cause the occupant(s) to leave the cradle are described as follows. One action involves causing the arm and cradle to rapidly decelerate and stop at the launch point. In this case the occupants slide off the cradle and into free parabolic flight. A second action is similar to that of a trap door. At the launch point the base of the cradle opens so that it no longer reacts the centrifugal force of the occupant(s). The cradle and occupant(s) continue at the same velocity; however, the cradle continues in a circular arc and the occupant(s) in a parabolic trajectory. The third and preferred action is to automatically alter the angle of the cradle with respect to the arm at the desired launch point, tipping it forward such that the bottom of the cradle is no longer tangent to the circle of travel, freeing the occupant(s) to fly off the cradle tangentially and into the free-flight trajectory. In other words, the tilt of the cradle results in a component of the centrifugal force sufficient to overcome the friction between the occupants and the cradle.

In a complete cycle the arm starts at bottom dead center, swings up through top dead center, on around and down through bottom dead center again and on up to the launch point.

The occupant(s) board the cradle when it is at bottom dead center. The arm is then clutched to the drive shaft so that the power unit lifts the cradle and occupant(s) in ferris wheel fashion to and just over top dead center, the arm turning counterclockwise in the view of FIG. 7. During this phase the occupant(s) feel the normal force of gravity. When the cradle and occupant(s) are just past top dead center the arm is declutched from the driveshaft and the cradle and passengers begin a fall in the arc described by the outer end of the arm. The occupants feel a momentary sensation of partial weightlessness associated with lateral acceleration. However, as gravity accelerates the rotational velocity of the arm the occupants experience centripetal force from the cradle resisting centrifugal force generated as their mass swings in the arc. As the occupants pass bottom dead center they will experience a total force equal to five times their weight comprised of a centrifugal force of four times their weight plus the force of gravity on their body mass. As the swing continues now upward, gravity will slow the rotational speed of the arm, decreasing the centrifugal force.

The cradle swings on its pivots which are above the center of gravity of cradle and occupants, rotating so that the net force, comprising centrifugal and gravity forces, holds the occupants firmly in the cradle.

Phantom line illustrations on FIG. 7 show the orientation of the arm, cradle and occupants in key locations in the downward and then upward swing to the launch point. At the launch point, mechanism described below over-rides the pendulous positioning of the cradle and causes it to tilt as shown in solid lines causing launch as previously described. The occupants are launched into free flight in a parabolic trajectory tangent to the arc of travel of the cradle at the launch point, to be retrieved safely at the end of the flight by energy absorbing deceleration means described elsewhere in this disclosure. The primary retrieval apparatus is supplemented by auxilliary deceleration pads 58 positioned under and around the acceleration appartus and beneath the free flight trajectory. These auxilliary deceleration pads are needed only in the event of misfunction of the acceleration apparatus.

A preferred mechanism for over-riding the pendular action of the cradle at the launch point is shown in FIG. 8. Referring to FIG. 8, cam segment 59 is adjustably attached to supporting tower 51. This can segment drives cam follower 60 which is connected to and drives slotted connecting rod 61, located roughly parallel to cradle arm 55. Slot 62 in rod 61 is supported by shaft 52 at the inner end of the rod. The outer end of rod 61 is pivoted to crank 63 at pin 64. Crank 63 is in turn rigidly connected to the cradle through shaft 57. The slot 62 allows pendular freedom of the cradle on its pivots except when this freedom is over-ridden by engagement of follower 60 with cam surface 59. In FIG. 8 the cradle, moving in the direction of arrow b, is approaching the launch point and rod 61 is being cammed essentially radially inward, causing the cradle to tilt clockwise in this view as indicated by arrow c. This tilt causes the occupant(s) to be launched as explained previously.

It has been found by experimental tests that when the cradle and its occupant(s) move through top dead center and start to fall freely, the cradle, is free, acquires an undesirable secondary pendular oscillation instead of responding smoothly to the rapidly changing resultant force. This oscillation is mechanically prevented from starting in the apparatus of FIG. 8 by engagement of follower 60 with cam segment 65. This engagement controls the motion of rod 61 and thereby the pendular swinging of the cradle.

In order to provide occupants in cradles open on the front side security during the powered climb and subsequent fall around the arm circle, the cradle is balanced such that the resultant of the gravity and centrifugal forces is directed mostly into the bed of the cradle but slightly into the cradle back. At the launch point, however, as explained above the cam 59 tilts the cradle forward so that the resultant force is inclined toward the open side for positive launch. Cam segments 59 and 65 of FIG. 8 are mounted by mounting bolts 66 to mounting plates 67 and 68. The slots shown in the cam segments permit both radial and angular adjustment of the cam segments with respect to the mounting plates 67 and 68. The mounting plates are pivoted to the tower at 52 and clamped by mounting bolts 69. The arcuate slots shown in the mounting plates permit pivotal adjustment of the plates and cam segments about the central shaft. These adjustments of the cam segments allow optimization of the cradle angle control as needed for performance and safety.

In addition to control of the tilt angle of the cradle for launch as discussed, the cam 59 can be used to impart a selected small angular roll velocity to the occupant(s) at the point of launch. The purpose is to cause the occupant(s) to roll slightly in flight so that landing orientation will be normal to the landing bed angle selected for optimal supine-position deceleration.

In addition to imparting a small angular velocity (roll) to the occupant(s) for proper orientation for landing, the mechanism of this and other launcher implementations may be designed or adjusted to provide greater predetermined angular velocities to occupants being launched to make them roll one or more turns or somersault one or more turns during free flight for added amusement thrills. People having ordinary skill in the art can tailor the mechanism design to produce any desired amount of angular velocity at launch.

As discussed previously, it is necessary that the free flight trajectory be consistently within a predictable envelope regardless of the variation in weight of the occupants of the apparatus. To achieve this consistency the velocity, direction and point of launch must be essentially consistent. The launch point and direction in this swinging-arm launcher are mechanically controlled. The launch velocity, however, is a function of the geometry and size of the apparatus, the locations of the centers of gyration of the elements involved, and the weights of the elements; the weight of the occupant(s) being variable. It has been determined by analysis and verified by experimental tests that the trajectories will be within a narrow envelope in spite of major variations in weight of the occupants if certain conditions are met. These conditions include low aerodynamic drag, low mechanical friction and, primarily, coincidence of the centers of gyration of the swinging apparatus and the occupants. Achieving exact coincidence would require the use of a weight located on an extension of the swinging arm beyond the attachment point of the cradle. The requirement for such a weight is diminished as the ratio of the weight of the arm to the combined weights of the cradle and occupants diminishes. In practice the launch velocity will be acceptably consistent over a wide range of occupant weight if the weight of the arm is kept low.

Persons having ordinary skill in the art will have no difficulty in designing any desired system of this type quantitatively. In general, with apparatus involving minimal looses, if the arm, cradle and occupant free fall from the top of the arc and the launch angle is at 45°, the theoretical flight range will be 3.41 times the arm radius. Also, for a 45° launch angle, (from any implementation of the invention), the horizontal flight range will be four times the flight height, if the launch and landing points are the same elevation.

In addition to gravity-actuated swinging-arm launchers, as described, a swinging-arm launcher powered by the energy of a prestressed spring may be used to launch a person or persons into flight. The spring or springs would be recocked by power means between launches. Such spring-powered swinging-arm launchers may be configured similar to ancient catapults which threw overhand or could be arranged to throw underhand.

The basic vertical-flight concepts disclosed and illustrated in FIGS. 1 through 3 can be used in compound implementations in which a number of people are successively, sequentially, or randomly launched into flight and caught in a number of cradles. The apparatus may be arranged in a circle or in a straight line. The purpose of compounding the apparatus is to accomodate more than one person at a time, to provide advantages in terms of operating economy and in heightened customer interest.

FIG. 9 illustrates compound implementations of the invention in which a number of persons 80 are launched from and land in cradles 81 mounted through cradle columns 82 to platform disk 83. The schematic figure represents several operationally-different variations as follows: 1. The entire platform disk may rise, carrying the cradle with it to launch the persons simultaneously into flight and then simultaneously catch them in the same cradles and decelerate them. 2. The disk may remain stationary but the cradle columns may move up and down in unison with respect to the fixed disk to accomplish simultaneous flight of all persons seated. 3. The disk may be stationary and the cradle columns may be actuated sequentially or randomly, to put the persons into flight at different times. 4. The persons may be launched into flight simultaneously; then the disk may rotate about a central shaft while the people are in flight, so that they all land in different cradles one or two away from those from which they were launched. It is also possible to launch persons so that they "leap frog" over seated persons before landing. 5. The disk may rotate about a central shaft at a substantially constant low velocity so that the person will have a lateral velocity at the time of launch and will "keep up" with their cradles while they are in flight and therefore land in the same cradles from which they were launched. 6. The cradles may spin about their own vertical axes at constant velocity. The persons are thus spinning at time of launch and will rotate through the same angle as the cradles while they are in flight, and will therefore land properly in the reoriented cradles. 7. Various combinations of disk rotation, cradle spinning, and launching into flight can be used to provide interesting multi-thrill rides. The bucking of wild horses can be simulated, for instance, with the exception that the thrown persons will land safely back in the "saddle" (cradle). The cradles can be mechanized to throw the persons to different heights at different times as well as to provide both positive and negative accelerations at sub-flight velocities.

Mechanisms to implement these concepts will be evident to those skilled in the art of machine design.

Other compound implementations of the invention give flight to a number of persons in a straight line, providing different free-flight thrills. FIG. 10 schematically illustrates a basic form of this implementation, wherein an extended cradle 84 in the form of a long trough is provided. The trough is long enough to accomodate a few to several dozen persons, not shown, simultaneously in single file. The trough cradle 84 with safety sidewalls 85 is supported by as many columns 86 as required, and each column is in turn actuated by a like number of actuators 87. These actuators are driven in synchronous by prime mover 88 from through-shaft 89. The trough cradle is actuated both vertically and longitudinally in such a manner as to launch the persons in it simultaneously into vertical or normal flight and then to move longitudinally while the persons are in flight; or to launch them into parabolic trajectories such that they progress along the length of the trough with successive cycles of the actuators. The trough may be level, slope downward throughout its length so that the persons progress downhill in a series of short flights, or it may slop uphill, so the persons entering the low end of the trough will automatically and effortlessly climb in travelling to the high end.

Alternatively, individual chairs or cradles arranged in a straight line may be substituted for the trough, such that the persons are thrown from chair to chair progressively along the line.

The actuators to operate these rectilinear implementations may be a modified version of the type previously described and shown in FIG. 2.

In all the implementations of this invention it is necessary that no person be launched into free flight unless the associated retriever area is clear of people launched previously. This requirement can be met by manual or automatic prevention of launching until the reliever apparatus is clear. However, since clearing the apparatus takes time, and economical operation dictates that as many people per hour should be accomodated as possible, the requirement can be met more profitably by progressively changing the alignment between the accelerating and retrieving apparatus so that several launches can occur in the time it takes to clear one retriever area. For example the launching apparatus can be encircled by retriever apparatus at the appropriate radial distance from it. Then, with either the launch apparatus or the retriever apparatus rotating slowly, clear retriever apparatus is continually presented to the launcher.

High capacity-per-hour installations of the invention may also be built by compounding any of the parabolic trajectory implementations disclosed. A number of launchers, operating separately or inter connected and using the same power source, may be arranged to launch people into separate retrievers or into a large single retriever having enough area to receive a number of persons from flight simultaneously.

In parabolic flight implementations of the invention, energy absorbing landing beds may be used in combination with acceleration apparatus. The landing bed is then separated from the accelerator apparatus, but preferably safety pads should be placed between the launcher and the landing bed, to decelerate the person in the event of a launcher malfunction.

Figure 11:
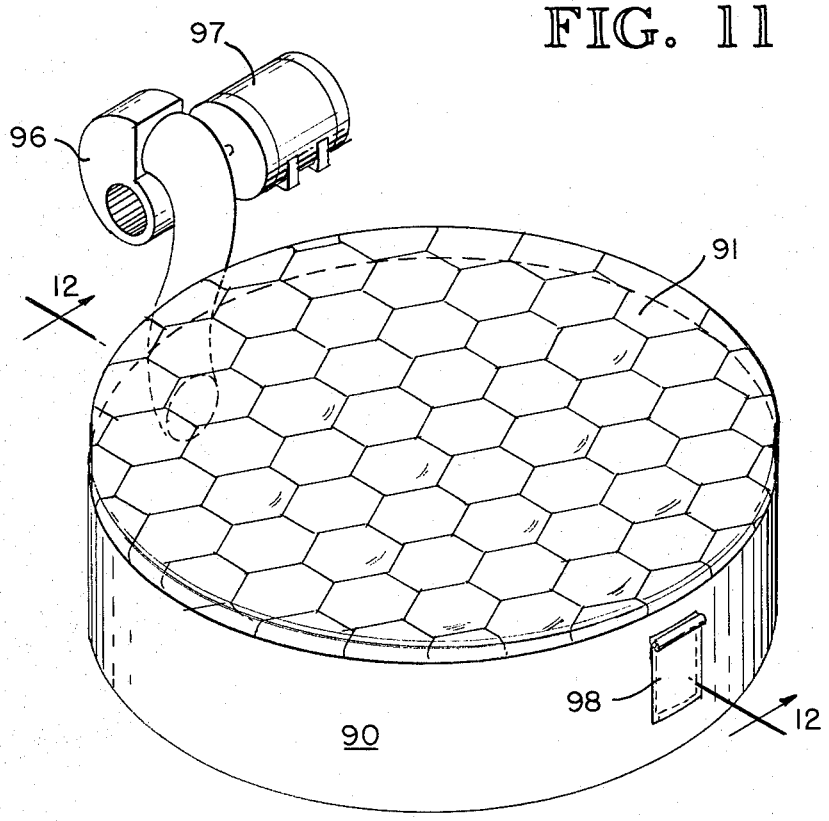
FIG. 11 is a schematic perspective view of a preferred columnar-top-airfilled, energy absorbing deceleration device.
Figure 12:
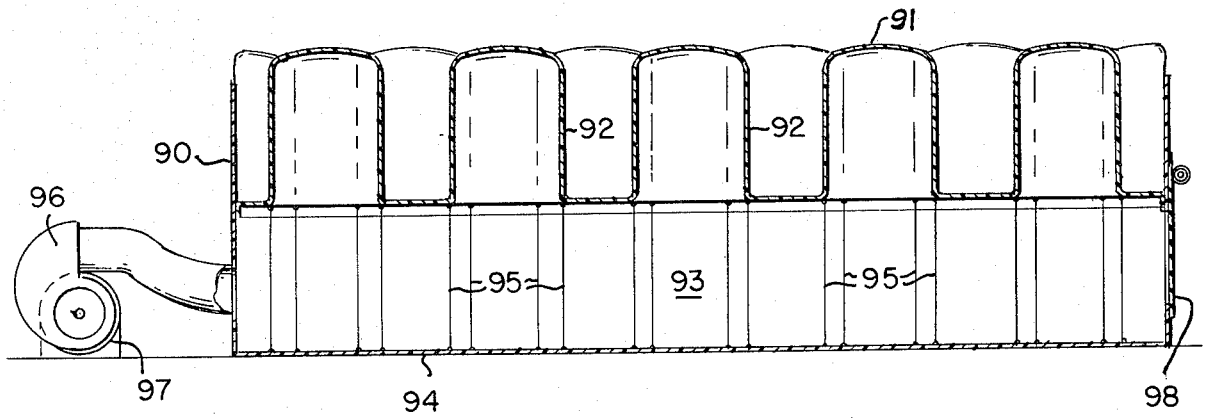
FIG. 12 is a sectional view taken at 12—12 of FIG. 11.

Whereas deceleration by the previously described timed mechanical apparatus is "active", requiring powered motion of the apparatus to match the velocity of the person(s) being retrieved at the time of contact, energy absorbing landing beds are "passive". There is no control required, and no motion other than that of the working surface of the bed caused by the landing of people on the bed. Simple commercially-available landing pads, such as those used by pole vaulters, may be used for retrieval of persons from parabolic flight launchers designed or adjusted to provide short flights of a few feet. The energy absorbing bed illustrated by FIGS. 11 and 12 is novel and overcomes the deficiencies of such simple landing pads and known prior art apparatus discussed previously. Use of this novel bed permits much longer safe flights.

FIG. 11 is a schematic, perspective view of a preferred landing bed apparatus of the subject invention. FIG. 12 is a sectional view taken at 12—12 in FIG. 11. The bed comprises a container 90 housing an inflated mattress made of thin smooth, flexible, tough material having a working face 91. The mattress comprises elongated tube members 92 arranged side by side and completely filling the upper portion of container 90. The tubes are airtight but their volumes are all interconnected since they are sealed to each other, and to the container side walls at the tube bottoms or second ends, but the tubes are open to an air plenum 93 at the bottom. The tubes are not attached to each other or to the container side wall except at the bottom.

The side wall edges of the lower or second ends of the tubes are structurally tied to container bottom 94 by a number of tension ties 95 such that the tension ties react the air pressure when the mattress is inflated by blower 96 powered by prime mover 97 and the closed upper or first ends of the tubes form a rough plane constituting the working face 91 of the mattress at the top of the container side wall.

The plan view configuration of the landing bed is preferably circular as shown in FIG. 11, but may be square or other shape. In a circular bed the side wall of container 90 should be made of heavy fabric or other flexible material. It should retain its shape only because of the internal inflation pressure. The side wall will then act as a girdle, retaining the size and round shape of the bed by reacting the inflation pressure in tensile stresses in the flexible side wall; yet, if a person should land on the edge of the bed, the side wall will deflect safely downward with the tube members.

A bed of any plan view shape other than circular will require rigid side walls to resist bending loads imposed by the inflation pressure. These rigid side walls will introduce a danger of injury in the event that a person lands on an edge of the bed, as well as increasing the cost and the weight of the deceleration bed. The chances of landing on a rigid side wall can be minimized by making the bed larger, but a larger bed would cost and weigh still more.

The volume comprised of the interconnected tubes and air plenum 93 is vented to the surrounding atmosphere through pressure regulating valve 98. The tubes may be arranged in a hexagonal pattern as shown in FIG. 11, or in a square pattern. The flexible, inflated tubes, being many in number, ample in girth and the contact with each other, will assume the cross section shape defined by the arrangement of their bases.

In operation, a person landing on the working face depresses the tubes contacted and is decelerated by the force necessary to depress them. The force will be nearly constant because the pressure in the mattress cannot increase significantly, being relieved by regulating valve 98. The slight increase in pressure will cause diminution or reversal of the blower flow. The mass of the flexible material of the tubes is very small, so that the reaction force generated by the sudden displacement of the material is negligible. The result is that the person is decelerated by a nearly constant force. Furthermore, because the pressure in the mattress increases only slightly, since displaced air was exhausted, the deceleration energy is expended and not stored and therefore there is little or no bounce. Position recovery of the surface is only at the low rate produced by the output of the blower. If, for any reason, a falling person approaches the working face with an appendage such as an arm, leg or head extended more or less normal to the surface, the appendage will either slide between tubes, meeting little resistance or, if the appendage contacts the end of a tube, that tube will collapse, turning inside-out, again offering little resistance to the appendage. Significant deceleration of the person begins only when the major mass of the body contacts and depresses a larger number of tubes.

It can be understood from this description that a person landing on the working face of this retriever will be decelerated by substantially constant force without harmful concentrated loads on any appendages. Further, the depth of the bed can be such that the level of the essentially constant deceleration force will be clearly within the range readily tolerated by virtually all people. Calculations and tests have shown that a mattress pressure of about $\frac{3}{4}$ pound per square inch above atmospheric will produce a deceleration force equal to five times the weight of the person being decelerated, (i.e. 5 g), with the deceleration force being constant. This deceleration level is known to be thrillingly enjoyable and will decelerate a person from the maximum flight velocities anticipated in any implementation to zero in about five feet.

With lesser landing velocities, associated with shorter flights, more conventional retrieval apparatus will be acceptable. Such apparatus includes foam mattreses or pads, inflated pads or combinations. Bouncing will be reduced if some of the air trapped in the mattress or pad is vented during the deceleration and replaced by suction as elasticity restores the mattress to its undeflected shape.

The foam mattress or combination foam/inflated mattress can incorporate the columnar member configuration described above; however, foam columns are not as effective as the fully inflated, thin material column members described above.

Figure 13:
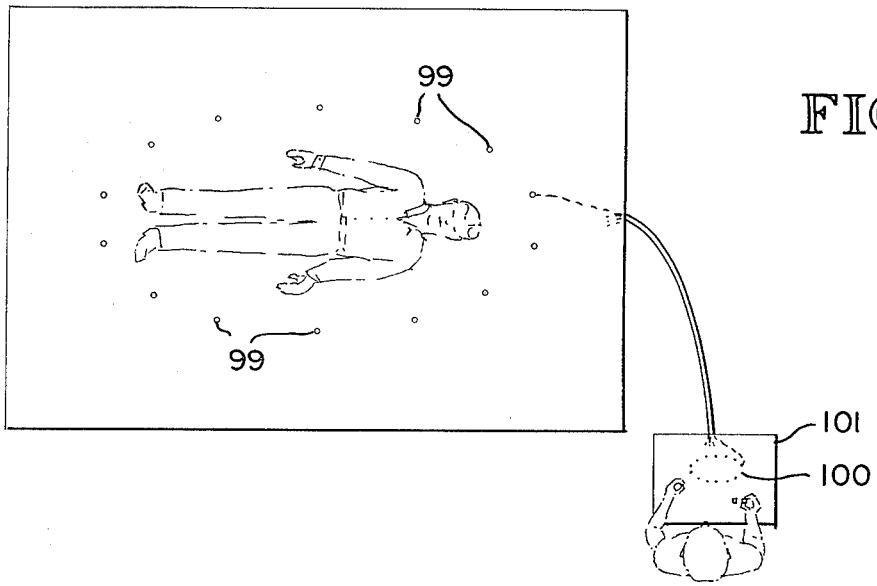
FIG. 13 is a diagramatic plan view of sensors arranged on the working surface of a deceleration device and of an associated indicator panel.

The working surface of the bed is sized and located so that there is ample working area to safely accomodate a normal dispersion of landing locations. There will be the possibility that functional and/or environmental factors may cause changes in the dispersion of landing points with some landings occurring closer to the edges of the working area than is desired. To prevent harmful effects from such changes, the working surface may be instrumented in any of a variety of ways to provide indications to the launcher operator(s) that the landing position is changing and in which direction. Such instrumentation is shown schematically in FIG. 13. Transducers 99, which produce an electrical signal when contacted with a force exceeding a specified level, are located around the normal landing area. Whenever a landing occurs in which part or all of the person lands outside the normal area, the signals generated by the transducers activate indicator lights 100 on a display 101 visible to the launcher operators. The display is geometrically similar to the working face and the location of the lighted lights shows immediately that an abnormal landing has occurred and the direction or location of the abnormal landing spot. Preferably the lights will be designed to stay on until they are manually extinguished by appropriate controls. Alternatively, the lights will remain on for a predetermined period of time. Also, arrangements can be such that signals indicating an abnormal landing will automatically shut down the launcher, which would then be restarted only when the difficulty has been resolved.

Another option is to arrange for the display to indicate both normal and abnormal landings and, further, to disable the launcher until the display indicates that the landing area is cleared.

The implementation of such instrumentation and displays is well within the capabilities of people having ordinary skill in the art. The simple systems described are recognized as samples of many which will suit the requirements and be within the scope of the invention.

It will be evident that the apparatus described for the implementation of various single parabolic flights of persons may be used in further combination of three or more devices to produce two or more serial flights in uninterrupted sequence. For instance, any of the parabolic flight launchers described may be used to launch one or more persons into flight and onto a slide as described, but the slide can relaunch persons instead of stopping them. The number of sequential serial flights possible is limited primarily by the total initial potential and kinetic energy available.

Figure 14:
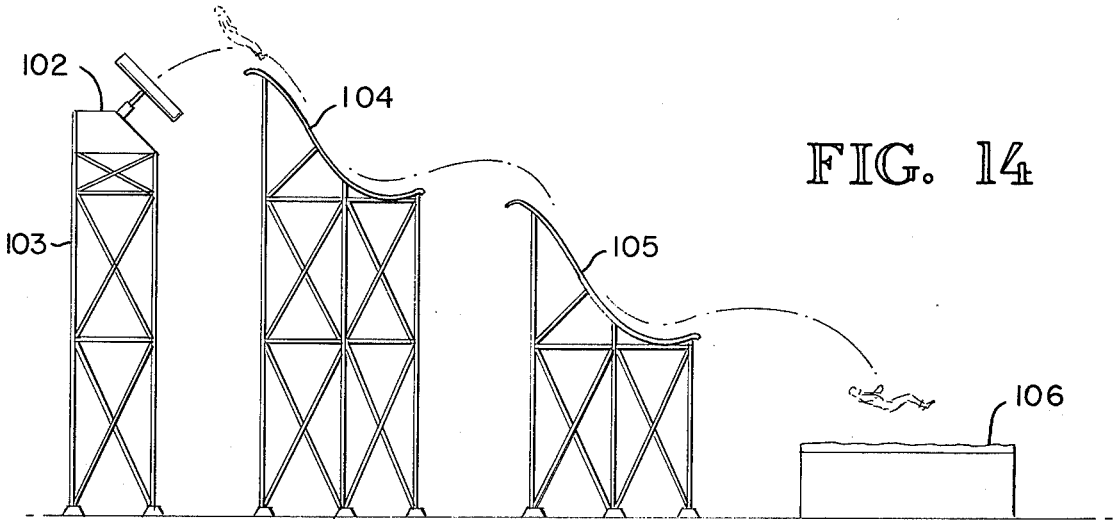
FIG. 14 is a diagrammatic elevation view of a multiple-flight implementation of the invention.

FIG. 14 schematically illustrates one 3-flight example of this sequential parabolic flights implementation of the subject invention. A mechanical launcher 102 mounted on a tower 103 launches one or more persons into a first flight, to be intercepted by slide 104. Slide 104 in turn relaunches the person(s) into a second flight to be intercepted by slide 105 which then relaunches the person(s) into a third flight, which is terminated in retriever 106.

The foregoing discription of the subject invention covers a variety of preferred and/or possible implementations of the invention. People skilled in the art will recognize that other embodiments and implementations are possible and all will be within the scope of the invention as defined by the appended claims.

What is claimed is:

1. An energy absorbing bed, having a working surface and comprising a support structure, a plurality of elongated, resilient members having first and second ends and longitudinal axes, said members being positioned adjacently within said support structure with said longitudinal axes oriented essentially normal to said working surface, said working surface comprising said first ends, said bed including a plenum chamber within said support structure and means for supplying air at pressure connected to said plenum and in which said members are made from thin, flexible material, said first ends are closed and said second ends are open and with said second ends in communication with said plenum chamber so that said members can be inflated with air supplied to said plenum chamber by said means for supplying air, and wherein said support structure comprises an essentially cylindrical sidewall having a bottom edge, an essentially circular bottom having an outer edge, a plurality of tension ties, said second ends of said members having edges, said sidewall being flexible and impermeable, and said bottom being impermeable, said bottom edge being sealed to said outer edge, said edges of said second ends being attached to said bottom by said tension ties, said edges of said second ends of adjacently positioned said members being sealed to adjacent edges and to said sidewall to form said plenum chamber.

2. The apparatus of claim 1 including means for maintaining said pressure essentially constant.

3. An amusement apparatus having means for accelerating at least one person into free flight, said means for accelerating comprising a base, a cradle and means attached to said base and to said cradle for causing controlled linear movement, acceleration and deceleration of said cradle, said means attached to said base and to said cradle being a spring powered linear actuator, said spring powered linear actuator comprising a telescopic assembly further comprising a shaft and a tube telescopically slidable on said shaft, at least 4 links interconnecting said shaft and said tube, said links having first ends and second ends, said first ends being pivoted to said shaft and said tube and said second ends being pivoted to each other and a tension spring connected to said second ends pivoted to each other such that relative telescopic motion of said shaft and said tube in a first direction causes extension of said tension spring and relative telescopic motion of said shaft and said tube in a direction opposite to said first direction is caused by contraction of said tension spring.

* * * * *